US005320740A

United States Patent [19]

Jorgensen et al.

[11] Patent Number: 5,320,740

[45] Date of Patent: Jun. 14, 1994

[54] QUENCHED MULTISTAGE FCC CATALYST STRIPPING

[75] Inventors: Diane V. Jorgensen, Wilmington, Del.; Ajit V. Sapre, West Berlin, N.J.

[73] Assignee: Mobil Oil Corporation, Fairfax, Va.

[21] Appl. No.: 1,881

[22] Filed: Jan. 8, 1993

[51] Int. Cl.[5] ..... C10G 11/00; C10G 11/05; C10G 11/18

[52] U.S. Cl. ..... 208/48 Q; 208/113; 208/118

[58] Field of Search ..... 208/119, 120, 118, 113, 208/151, 48 Q

[56] References Cited

U.S. PATENT DOCUMENTS

| | | | |
|---|---|---|---|
| 4,481,103 | 11/1984 | Krambeck et al. | 208/120 |
| 4,789,458 | 12/1988 | Haddad et al. | 208/151 |
| 4,978,440 | 12/1990 | Krambeck et al. | 208/113 |
| 5,043,058 | 8/1991 | Forgac et al. | 208/113 |

*Primary Examiner*—R. Bruce Breneman
*Assistant Examiner*—Lorna M. Douyon
*Attorney, Agent, or Firm*—Alexander J. McKillop; Malcolm D. Keen; Richard D. Stone

[57] ABSTRACT

Catalyst stripping in the fluid catalytic cracking process is improved by cooling the spent catalyst to quench catalytic condensation reactions, then stripping the cooled catalyst in a primary stripper, followed by heating and a stage of hot stripping. Quenched stripping reduces coke make by reducing conversion of light olefins, made during the FCC process, into coke.

17 Claims, 2 Drawing Sheets

QUENCHED MULTISTAGE FCC CATALYST STRIPPING

FIELD OF THE INVENTION

This invention relates to fluid catalytic cracking and more particularly to stripping cracked hydrocarbons from spent cracking catalyst.

BACKGROUND OF THE INVENTION

The fluid catalytic cracking (FCC) process has become well-established in the petroleum refining industry for converting higher boiling petroleum fractions into lower boiling products, especially gasoline.

In the fluid catalytic process, a finely divided solid cracking catalyst promotes cracking reactions. The catalyst is in a finely divided form, typically with a particles of 20–100 microns, with an average of about 60–75 microns. The catalyst acts like a fluid (hence the designation FCC) and circulates in a closed cycle between a cracking zone and a separate regeneration zone.

In the cracking zone, hot catalyst contacts the feed so as to effect the desired cracking reactions and coke up the catalyst. The catalyst is then separated from cracked products which are removed from the cracking reactor for further processing. The coked catalyst is stripped and then regenerated.

A further description of the catalytic cracking process may be found in the monograph, "Fluid Catalytic Cracking With Zeolite Catalysts", Venuto and Habib, Marcel Dekker, N.Y., 1978, incorporated by reference.

Although the FCC process has been around more than 50 years, there are still many problem areas. A significant problem is poor stripping. The conventional stripping, in a single stage, by counter-current contact with steam, leaves a lot of cracked product adsorbed on or entrained with spent catalyst. From 10 to perhaps 40 to 50% of the material burned as coke in the regenerator is potentially recoverable hydrocarbon. Thus much work has been done to improve stripping, ranging from long residence time strippers to hot stripping designs.

U.S. Pat. No. 4,481,103, Krambeck et al taught conventional stripping followed by another 1–30 minutes of stripping at moderate temperature.

U.S. Pat. No. 4,789,458 Haddad et al taught an FCC process with a conventional stripper followed by a hot stripper. Hot stripping was achieved by adding some hot regenerated catalyst to the catalyst discharged from the conventional stripper.

Various other stripper arrangements have been proposed, including cyclonic strippers directly connected to an FCC riser reactor outlet.

We looked at these stripping approaches, and were concerned that none provided the optimum solution. Most of these approaches to stripping started with conventional steam stripping, wherein 1 to 5 wt % steam contacts spent catalyst discharged from a riser reactor. They usually then tried to improve stripping by heating the catalyst, or stripping it longer. We believed that it was important to quench and cool the catalyst, rather than heat it, as the first step. This would be considered a step backward by most FCC experts, in that the conventional wisdom is that hot stripping is better stripping. While this is true from a strict diffusion limited view of stripping, it ignores the complex and interconnected activities that go on in a conventional stripper.

Coke on FCC catalyst is associated to the CCR content of the feed stock and to the catalytic chemistries occurring in the FCC. The quenched stripper concept addresses minimizing catalytic coke formation in the stripper; whereas, the hot second zone of the stripper addresses removal of both CCR coke and catalytic coke.

Though no definitive reaction pathway for coke formation has been developed, numerous well accepted factors affect the rate of catalytic coke formation: reaction temperature and time, the nature of the catalyst, the partial pressure of the oil/coke precursors, and the type of oil/coke precursors. Higher reaction temperature will enhance the formation of coke if the coke precursors are present, and will continue to dehydrogenate soft coke to hard coke. Numerous catalyst functionalities affect the rate of coke formation, e.g. dehydrogenation activity via contaminate metals such as Ni, V, Fe; hydrogen transfer ability of the catalyst; and the concentration and strength of Lewis and Brondsted acid sites. The hydrocarbon type also affects coke formation. Hightower and Emmett [J. W. Hightower & P. H. Emmett, J.Am.Chem.Soc., 87; 939 (1965)] found olefins to have a much higher propensity for coke formation than paraffins or aromatics of nearly equivalent molecular weight. Light olefins and aromatics are the predominate FCC product hydrocarbons found in the stripper, thus minimizing their reaction rate to coke formation is of primary importance.

We seek to improve stripper performance by first removing the oil/coke precursors from the interstitial void volume of the stripper at a lower temperature than conventional FCC stripping. The lower temperature reduces the catalytic condensation reactions responsible for catalytic coke formation. This reduces the formation of coke in the stripper relative to conventional higher temperature stripping. We avoid reducing the temperature below 900° F. at the top of the stripper, as this could condense heavy oil products on the catalyst.

We discovered that cool stripping of catalyst, followed by a hot stripping stage, produced significantly less coke than the conventional steam stripping, and much less than hot stripping.

BRIEF SUMMARY OF THE INVENTION

Accordingly, the present invention provides a fluid catalytic cracking process for cracking hydrocarbons comprising: feeding active hot solid zeolite cracking catalyst and crackable hydrocarbon feed to a cracking zone at an average cracking zone temperature within the range of 950° to 1400° F.; cracking said feed in said cracking zone to produce cracked hydrocarbon products and spent catalyst containing coke and adsorbed hydrocarbon vapor having a temperature of 900° to 1300° F. and sufficient to cause thermal cracking of said adsorbed hydrocarbon vapor; separating said spent catalyst from said cracked hydrocarbon products to produce a spent catalyst stream containing adsorbed hydrocarbon vapor; cooling said spent catalyst by at least 10° F. to produce quenched catalyst; stripping said quenched catalyst in a primary catalyst stripping means at catalyst stripping conditions including a catalyst residence time of 10 to 600 seconds by contact with a stripping fluid to produce stripped quenched catalyst containing a reduced amount of adsorbed hydrocarbon vapor and a primary stripper vapor product comprising stripping fluid and desorbed hydrocarbons which is removed as a product from said primary stripping means; regenerating said stripped, quenched catalyst in a catalyst regeneration means operating at catalyst regeneration conditions to produce regenerated catalyst; and recycling said regenerated catalyst to said cracking reactor to crack additional amounts of hydrocarbon feed.

In another embodiment, the present invention provides a fluid catalytic cracking process for cracking hydrocarbons comprising: mixing in a base portion of a riser reactor cracking catalyst containing at least 25 wt % zeolite Y, based on the zeolite Y content of makeup FCC catalyst, and crackable hydrocarbon feed at riser cracking conditions including a catalyst:feed weight ratio of 1:1 to 10:1 and mixture temperature within the range of 975° to 1200° F., and a pressure from about atmospheric to 50 psig; cracking said feed in said riser reactor to produce cracked hydrocarbon products including C2–C4 olefins and spent catalyst containing coke and adsorbed and entrained hydrocarbon vapor which are discharged from the top of the riser reactor at a temperature of 950° to 1150° F.; separating said spent catalyst from said cracked hydrocarbon products to produce a cracked product stream which is removed as a product and a spent catalyst stream containing adsorbed and entrained hydrocarbons including C2–C4 olefins at a temperature of 950° to 1150° F. and sufficiently high to cause catalytic condensation reactions of said adsorbed and entrained C2–C4 olefins on said cracking catalyst to form coke; cooling said spent catalyst by at least 10° F. to produce quenched spent catalyst; stripping said quenched catalyst in a primary catalyst stripping means at catalyst stripping conditions including a catalyst residence time of 10 to 600 seconds by contact with stripping steam in an amount equal to 0.5 to 5.0 wt % of fresh feed to produce stripped quenched catalyst containing a reduced amount of adsorbed and entrained hydrocarbon vapor and a primary stripper vapor product comprising stripping fluid and desorbed and displaced hydrocarbons which is removed as a product from said primary stripping means; heating said stripped quenched catalyst at least 10° F. to produce heated spent catalyst; stripping said heated spent catalyst in a secondary catalyst stripping means by contact with a stripping fluid at catalyst stripping conditions including a catalyst residence time of 20 to 2000 seconds to produce hot stripped catalyst and a secondary stripper vapor product comprising stripping fluid and desorbed hydrocarbons; regenerating said hot stripped catalyst in a catalyst regeneration means operating at 1000° to 1500° F., by contact with oxygen or an oxygen containing gas to produce regenerated catalyst; and recycling said regenerated catalyst to said cracking reactor to crack additional amounts of hydrocarbon feed.

In another embodiment, the present invention provides a fluid catalytic cracking process for cracking hydrocarbons comprising: mixing regenerated cracking catalyst, containing at least 30 wt % Y zeolite, based on the Y zeolite content of fresh catalyst added to the process, and crackable hydrocarbon feed in the base of a riser reactor cracking zone at an average mixture temperature within the range of 975° to 1200° F.; cracking said feed in said cracking zone to produce cracked hydrocarbon products including C2 to C4 olefins and spent catalyst; separating said spent catalyst from said cracked hydrocarbon products to produce a spent catalyst stream containing coke and entrained and adsorbed hydrocarbon vapor and having a temperature of 950° to 1150° F. and sufficient to polymerize said olefins to form high molecular weight polymers which condense onto said spent catalyst; cooling said spent catalyst by at least 20° F. to produce quenched catalyst by injecting a quench stream comprising liquid water; stripping said quenched catalyst in a primary catalyst stripping means at catalyst stripping conditions including a catalyst residence time of 10 to 600 seconds by contact with a stripping fluid to produce stripped quenched catalyst containing a reduced amount of adsorbed C2–C4 olefins and a primary stripper vapor product comprising stripping fluid and desorbed C2–C4 olefins which are removed as a product from said primary stripping means; heating said stripped quenched catalyst at least 25° F. by direct contact heat exchange with regenerated cracking catalyst to produce heated spent catalyst; stripping said heated spent catalyst in a secondary catalyst stripping means by contact with a stripping fluid at catalyst stripping conditions including a catalyst residence time of 20 to 2000 seconds to produce hot stripped catalyst and a secondary stripper vapor product comprising stripping fluid and desorbed hydrocarbons; regenerating said hot stripped catalyst in a catalyst regeneration means operating at catalyst regeneration conditions to produce regenerated catalyst; and recycling said regenerated catalyst to said cracking reactor to crack additional amounts of hydrocarbon feed.

DESCRIPTION OF PREFERRED EMBODIMENTS

Figure 1:
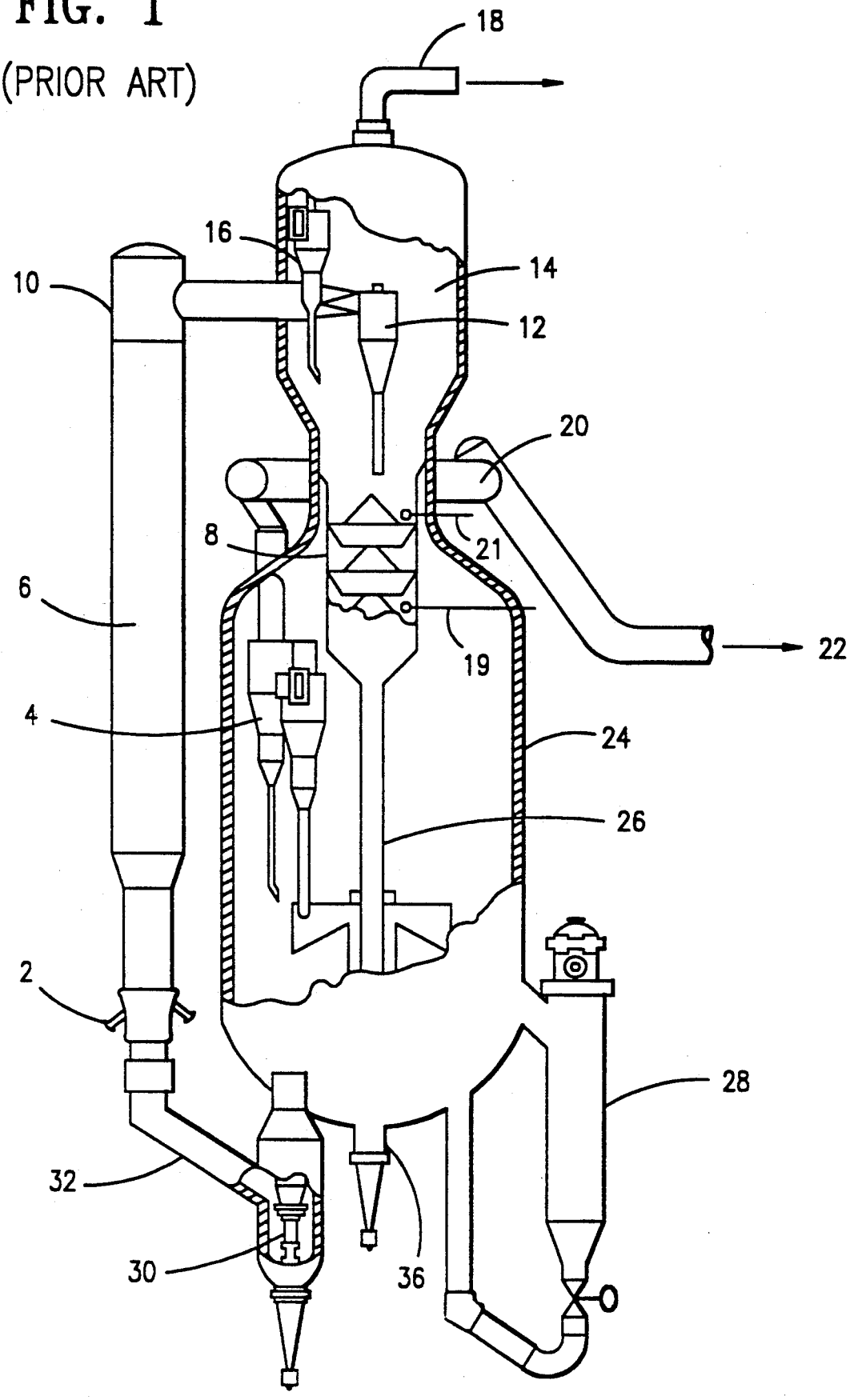
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by steam inlet and distributors 19 and 21 at lower and upper levels in the stripper. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2:
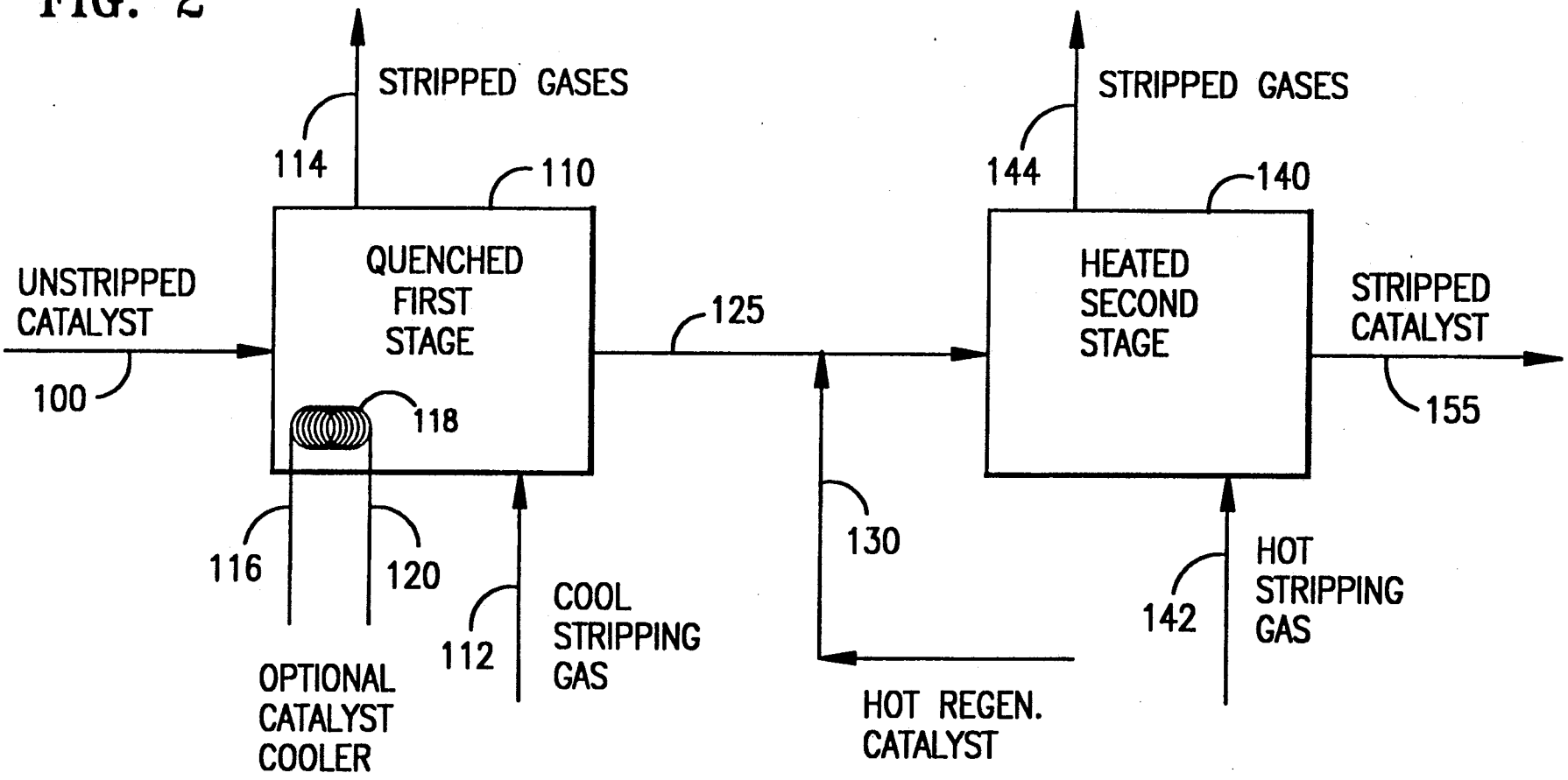
FIG. 2 shows a block diagram of a preferred embodiment, indirect quenching, then heating in a multi-stage stripper.

FIG. 2 shows a simplified block diagram with a quenched first stage of stripping followed by a hot stripping stage.

Spent catalyst discharged from the riser reactor is added via line 100 to the quenched first stage stripper 110. The first stage of stripping is quenched because the temperature is reduced at least enough to reduce the rate of catalytic, coke forming condensation reactions in the stripper. The first stage may be quenched by adding unusually cool stripping fluid via line 112, or by use of an indirect catalyst cooler 118. A cool fluid such as boiler feed water is added via line 116 and a heated fluid such as steam is withdrawn via line 120. Stripped gases are removed via line 114, and cool stripped catalyst withdrawn via line 125.

The cool stripped catalyst is charged to the heated second stripping stage 140, and heated by the addition of enough hot regenerated catalyst via line 130 to heat it to a temperature at least as high as the riser outlet temperature. Additional stripping gas, such as steam, is added via line 142, and stripped gases are removed via line 144. Then by now thoroughly stripped catalyst is withdrawn via line 155 and charged to the regenerator, not shown.

FIG. 1 shows the conventional approach to catalyst stripping, essentially a one stage stripper, perhaps with steam addition at several elevations in the stripper. This type of stripping occurs in almost all FCC units operating today.

FIG. 2 shows our approach, a marked departure from conventional approaches to hot stripping. To show the differences, hot stripping will be briefly reviewed and compared to quenched stripping.

Conventional Hot Stripping

Refiners have tried various hot strippers, usually with spent catalyst heated by direct contact heat exchange with hot regenerated catalyst. A good example of this approach to stripping is shown in Haddad et al U.S. Pat. No. 4,789,458 which has been incorporated by reference. Referring to FIG. 3, catalyst is first steam stripped, then charged to a generously sized hot stripper under the regenerator. The steam stripped catalyst in line 138 is heated by mixing with hot regenerated catalyst in line 206, and the mixture charged to the hot stripper.

Arguably the stripping scheme shown in U.S. Pat. No. 4,789,458 (and in every hot stripper in the patent literature) shows a cool first stage of stripping followed by hot stripping. The first stage is "cooled" by the action of stripping steam which is never as hot as the spent catalyst discharged from the riser. The second stage of course is heated by direct contact heat exchange with hot regenerated catalyst.

The conventional steam stripping approach shown in the patent literature, and as practiced commercially, never does enough cooling to end most thermal reactions that occur. The amounts of stripping steam added are on the order of 1 to 5 wt % of the fresh feed. Catalyst outweighs feed, usually by a ratio of 5:1 or more. Thus, the weight of stripping steam is usually about two orders of magnitude less than the weight of spent catalyst. There is some cooling, but not enough to prevent most of the thermal cracking and thermally induced coke formation that occurs in conventional strippers.

Conventional FCC strippers use steam for stripping. This steam is typically at 700° F. with recommended flow rates of 3–4 wt. % on fresh feed. Cooling due to this steam is negligible. An energy balance shows that for a top stripper temperature of 980° F., operation at 6 cat/oil, and stripper steam at 700° F. and at rates of 4 wt. % on feed, the adiabatic stripper dT (drop) would be 3° F.

Thus it can be seen that conventional steam stripping does cool the catalyst some, but almost always less than 5° F.

QUENCHED STRIPPING

We want to cool the catalyst as much as possible, as soon as possible, after leaving the reactor. We do this not so much to reduce thermal reactions, which are a factor, but primarily to reduce catalytic reactions. Modern FCC zeolites have very large zeolite Y contents, frequently 30 to 40 wt % Y zeolite based on fresh makeup FCC catalyst, and such catalyst retain considerably catalytic activity despite the presence of large amounts of coke. This active catalyst can readily promote condensation reactions among light olefins, which are produced in abundance in the riser reactor. Quenching, or quick cooling of spent catalyst by even just 10° F. is beneficial in reducing the rate of catalytic condensation reaction, but greater temperature reductions are preferred, such as by 20° F. or 30° F. or more. Such temperature reductions can be achieved in conventional strippers with conventional amounts of stripping H2O, provided it is added as water rather than as fairly hot steam as in now done.

If water were injected instead of steam in an FCC unit operating at the same conditions as discussed above, which resulted in a 3° F. temperature drop through the stripper, an order of magnitude more temperature drop may be achieved in the stripper. Thus if water at 150° F. were injected into the stripper instead of steam, at the same mass rate of water as that of steam, the adiabatic stripper dT (drop) would be 33° F. Higher water injection rates may be used to lower the stripper temperature more, or a mixture of steam and water may be injected, e.g., a 50/50 by weight mix of low pressure steam and water may be injected into the stripper to achieve a quench effect of about 18° to 20° F., depending on steam pressure. Such a mixture is easy to inject into a stripper.

The water, or steam/water injection could be staged though the stripper. Where the water evaporates is where the dT will occur. One easy way to achieve the benefits of quenched stripping in conventional FCC strippers with multiple levels of steam injection would be to inject a significant amount of water or steam/water high up in the stripper and then inject conventional amounts of steam at the traditional "bottom" of the stripper. Conventional strippers could also be modified by the inclusion of extra steam or steam/water injectors near the top of the stripper to provide for quenching of spent catalyst in the top of, or just above, the stripper.

CRACKING CATALYST

Conventional cracking catalysts may be used. The most benefit will be observed from quenched stripping when high zeolite content FCC catalyst is used. It is this same high activity zeolite catalyst which made short contact time riser cracking possible, and which created conditions in the conventional stripper which led to excessive amounts of condensation reactions. The process of the present invention also permits use of even higher zeolite content FCC catalyst.

Large pore zeolite contents of at least 25% should be used, and preferably in excess of 30 wt %, and most preferably in excess of 40 wt % large pore zeolite. Practically every FCC unit in the world uses zeolite Y cracking catalyst, and dealuminized forms of this zeolite such as DEAL Y, USY, and even ultra-hydrophobic Y (UHP-Y) may be used, with or without rare earth stabilization. RE-USY based cracking catalyst will be preferred by many refiners.

The catalyst preferably also contains some shape selective zeolite, either as an integral part of the cracking catalyst or as a separate additive. Any crystalline material having a Constraint Index of 1–12 can be used herein but ZSM-5 is especially preferred. Details of the Constraint Index test procedures are provided in J. Catalysis 67, 218–222 (1981), U.S. Pat. No. 4,016,218 and in U.S. Pat. No. 4,711,710 (Chen et al), which are all incorporated by reference.

Preferred shape selective crystalline materials are exemplified by ZSM-5, ZSM-11, ZSM-12, ZSM-23, ZSM-35, ZSM-48, ZSM-57 and similar materials.

ZSM-5 is described in U.S. Pat. No. 3,702,886, U.S. Pat. No. Reissue 29,948 and in U.S. Pat. No. 4,061,724 (describing a high silica ZSM-5 as "silicalite").

ZSM-11 is described in U.S. Pat. No. 3,709,979.

ZSM-12 is described in U.S. Pat. No. 3,832,449.

ZSM-23 is described in U.S. Pat. No. 4,076,842.

ZSM-35 is described in U.S. Pat. No. 4,016,245.

ZSM-38 is described in U.S. Pat. No. 4,046,859.

ZSM-48 is described in U.S. Pat. No. 4,350,835.

These patents are incorporated herein by reference.

Zeolites in which some other framework element is present in partial or total substitution of aluminum can be advantageous. Elements which can be substituted for part of all of the framework aluminum are boron, gallium, zirconium, titanium and trivalent metals which are heavier than aluminum. Specific examples of such catalysts include ZSM-5 and zeolite beta containing boron, gallium, zirconium and/or titanium. In lieu of, or in addition to, being incorporated into the zeolite framework, these and other catalytically active elements can also be deposited upon the zeolite by any suitable procedure, e.g., impregnation.

Preferably, relatively high silica shape selective zeolites are used, i.e., with a silica/alumina ratio above 20/1, and more preferably with a ratio of 70/1, 100/1, 500/1 or even higher.

Preferably the shape selective zeolite is placed in the hydrogen form by conventional means, such as exchange with ammonia and subsequent calcination.

CRACKING CONDITIONS

The FCC unit may operate under conventional FCC conditions at a temperature in the range from about 1000° F. to about 1350° F., with a Catalyst-to-Oil ratio from about 1:1 to about 20:1, and a contact time of from about 0.1 to about 20 sec. It is preferred to crack the charge stock in an upflowing riser conversion zone discharging into cyclonic separation means in an upper portion of an enlarged vessel in which the products of cracking are separated from catalyst.

CRACKING FEEDS

Cracking feeds may be conventional, such as petroleum fractions having an initial boiling point of at least 500° F. (260° C.), a 50% point at least 750° F. (399° C.), and an end point of at least 1100° F. (593° C.). Such fractions include gas oils, vacuum gas oils, thermal oils, residual oils, cycle stocks, whole top crudes, tar sand oils, shale oils, synthetic fuels, heavy hydrocarbon fractions derived from the destructive dehydrogenation of coal, tar, pitches, asphalt, hydrotreated feedstocks derived from any of the foregoing, and the like.

EXPERIMENTS

Example 1

To quantify the maximum amount of catalytic coke formed in an FCC stripper, stripped and unstripped catalyst samples from 3 runs were taken from a fast fluid bed riser type pilot plant. These samples shall be referred to as spent and unstripped. The spent catalyst samples experience typical stripper conditions of steam stripping at 980° F. prior to retrieving the sample; whereas, the unstripped samples experienced no stripped. Then the samples were stripped with nitrogen at 600° F. for 30 minutes, then steam stripped for 5 minutes at 1000° F. The coke contents of the samples are given below in Table I. It is clear that the additional stripping removed little coke from the spent catalysts. However, 15–25% coke reduction was found with low temperature stripping followed by stripping at 1000° F., which is similar to the temperature used in many catalyst strippers. Most catalyst strippers are a little cooler than this, so 1000° F. could be considered a mild hot stripping treatment.

TABLE I

| Coke Content of Catalysts | | |
|---|---|---|
| A<br>Coke, wt. %<br>After Convent.<br>Stripping<br>@ 980° F. | B<br>Coke, wt. %<br>Conventional +<br>600° F. $N_2$ Strip +<br>1000° $H_2O$ Strip | C<br>Coke, wt. %<br>No Con. stripping<br>600° F. $N_2$ Strip +<br>1000° $H_2O$ Strip |
| 0.9754 | 0.9524 | 0.7024 |
| 0.9224 | 0.9218 | 0.7478 |
| 1.042 | 1.035 | 0.8302 |

The results in this table may be confusing at first. They show that extensive extra stripping treatments conducted after a conventional stripping treatment may do little for coke removal, but quenched stripping followed by 1000° F. stripping reduces coke.

Column A represents conventional steam stripping at 980° F. There are three different samples, each of which has a somewhat different coke level, as is typical in real experimental data.

Column B represents catalyst given a conventional steam stripping treatment, and then given a stage of cool stripping (at 600° F., with nitrogen for 30 minutes), then given a hot stripping treatment at 1000° F. with steam for 5 minutes.

Column C shows what happens when the conventional steam stripping treatment is eliminated, and a quenched stripping stage substituted for it. There is a significant reduction in the amount of coke on catalyst.

Example 2 (Prior Art—Base Case)

The following example is based on actual lab experiments designed to simulate what would happen in a commercial FCC unit processing 2000 barrels/hour of feed with a single stage regenerator. The dense bed of the regenerator has an inventory of 150 short tons (136.07 metric tons) of catalyst. The feed composition is provided in Table II

TABLE II

| Typical FCC Feed Properties | |
|---|---|
| API | 24.4 |
| Total Nitrogen, ppm | 1100 |
| Sulfur, wt. % | 1.0 |
| CCR, wt. % | 1.0 |
| Anil. Pt., °F. | 170 |
| D1160, distil. °F. | |
| 10% | 584 |
| 50% | 770 |
| 90% | 1042 |

A conventional equilibrium faujasite FCC catalyst was used.

FCC operating conditions in general are listed below, with special emphasis given to stripper operating conditions. Operating conditions were selected to mimic as much as possible a commercial stripper having:

Height of fluidized bed: 16 ft (4.9 m)

Density of fluidized bed: 40 lb/ft3 (650 kg/m3)

Average temperature of stripping stage: 980°-1000° F.)

Superficial velocity of steam: 1 ft/sec (0.3 m/sec)

WHSV: 5 hr-1 based on catalyst

Temperature of spent catalyst charged to stripper: 980°-1000° F.

Temperature of spent catalyst from stripper: 980°-1000°, less a dT of about 5° F.

The coke on stripped catalyst is 1.341 wt %.

While this is the base case, the case of interest is this followed by a hot stripper. Addition of enough regenerated catalyst to heat the catalyst to various temperatures was considered. In every case, going to higher temperatures increased the coke make, because the higher temperatures promoted thermal cracking of feed to light ends and coke.

Example 3 (Case 2)

This case studies what happens in a conventional steam stripper followed by a hot stripper. Everything is the same as in Case 1, except that 40 seconds of residence time in a conventional steam stripper is followed by about 5 minutes of catalyst residence time in a hot stripper. This approach is similar to that shown in, e.g., FIG. 2 of U.S. Pat. No. 4,789,458 with a conventional steam stripper disposed as an annulus about the riser reactor 104, and the steam stripped catalyst mixing with hot regenerated catalyst from line 206 and entering a long residence time, and hot, second stage catalyst stripper under the catalyst regenerator.

This case shows that two stage stripping, with hot stripping in the second stage, is a significant improvement over conventional one stage stripping, and a single stage of hot stripping. Case 2 also shows that going to higher temperature than 1000° F. does not improve stripping, at least not within any feasible temperature limit.

Example 4 (Invention—Case 3)

In this study, the same FCC unit, operating at the same conditions, and with the same catalyst and feed, was studied with a quenched stripper. The first stage of stripping was at a temperature 100° F. cooler than the riser top temperature. Thus 40 seconds of stripping at 900° F. was followed by hot stripping for 5 minutes of catalyst residence time at various temperatures. Our calculations show long residence time low temperature stripping was better than long residence time hot stripping in general. Our calculations also show that, for the first time, going to higher temperatures in a hot stripper could reduce coke make rather than increase it.

A side by side comparison of all cases is presented below in Table 3.

TABLE 3

| PURGE CONDITIONS N2 purge & stripping gas | CASE 1 INCREASE Temp. to Strip Temp | CASE 2 HOLD Temp @ 1000° F. | CASE 3 HOLD Temp @ 900° F. |
|---|---|---|---|
| Purge Time, seconds | 40 | 40 | 40 |
| 1st/Cool Strip seconds | 0 | 40 | 40 |
| 1st stage temperature | — | 1000° F. | 900° F. |
| Hot Stage Stripping, min | 5 | 5 | 5 |
| Wt % coke remaining after hot stripping at: | | | |
| 900° F. | — | — | 1.188 |
| 1000° F. | 1.341 (base) | 1.202 | 1.257 |
| 1100° F. | 1.391 | 1.358 | 1.265 |
| 1300° F. | 1.460 | 1.251 | 1.154 |
| 1500° F. | 1.861 | 1.226 | 1.080 |

These data show that an entirely different approach is needed for an efficient multi-stage stripper. Rather than immediately resort to heating to improve stripping, it is best to stop catalytic condensation reactions and remove the readily strippable hydrocarbons, and only then proceed to a hot stripping step. We believe that the conventional approach to hot stripping accelerates conversion of adsorbed and entrained (and potentially strippable) hydrocarbons to coke. While higher temperature stripping is beneficial, it should not be used merely to enhance stripping of entrained or lightly adsorbed hydrocarbons.

The process of the present invention provides refiners with a way to significantly improve their FCC stripping operation. Better stripping increases yields of valuable products, and reduces the amount of coke and of hydrocarbons which are burned in the regenerator. This reduces both the regenerator temperature and the steam partial pressure in the regenerator. Reduced temperatures allow winding up of the unit, while reduced steam partial pressure will extend catalyst life, and create an atmosphere not conducive to formation of mobile, highly oxidized vanadium species.

We claim:

1. A fluid catalytic cracking process for cracking hydrocarbons comprising:

(a) feeding active hot solid zeolite cracking catalyst and crackable hydrocarbon feed to a cracking zone at a an average cracking zone temperature within the range of 950° to 1400° F.;

(b) cracking said feed in said cracking zone to produce cracked hydrocarbon products and spent catalyst containing coke and adsorbed hydrocarbon vapor having a temperature of 900° to 1300° F. and sufficient to cause thermal cracking of said adsorbed hydrocarbon vapor;

(c) separating said spent catalyst from said cracked hydrocarbon products to produce a spent catalyst stream containing adsorbed hydrocarbon vapor;

(d) cooling said spent catalyst by at least 10° F. to produce quenched catalyst;

(e) stripping said quenched catalyst in a primary catalyst stripping means at catalyst stripping conditions including a catalyst residence time of 10 to 600 seconds by contact with a stripping fluid to produce stripped quenched catalyst containing a reduced amount of adsorbed hydrocarbon vapor and a primary stripper vapor product comprising stripping fluid and desorbed hydrocarbons which is removed as a product from said primary stripping means;

(f) regenerating said stripped, quenched catalyst in a catalyst regeneration means operating at catalyst regeneration conditions to produce regenerated catalyst; and (g) recycling said regenerated catalyst to said cracking reactor to crack additional amounts of hydrocarbon feed.

2. The process of claim 1 wherein said stripped quenched catalyst is heated at least 10° F. to produce heated spent catalyst, and said heated spent catalyst is stripped in a secondary catalyst stripping means by contact with a stripping fluid at catalyst stripping conditions including a catalyst residence time of 20 to 2000 seconds to produce hot stripped catalyst and a secondary stripper vapor product comprising stripping fluid and desorbed hydrocarbons, and said hot stripped catalyst is charged to said catalyst regeneration means.

3. The process of claim 1 wherein the cracking reactor is a riser cracking reactor with a reactor outlet temperature of 950° to 1100° F.

4. The process of claim 1 wherein the spent catalyst is cooled at least 20° F. to produce quenched catalyst.

5. The process of claim 1 wherein the spent catalyst is simultaneously cooled and stripped in said primary stripper.

6. The process of claim 1 wherein the spent catalyst is cooled at least 50° F. before or during primary stripping.

7. The process of claim 2 wherein the quenched catalyst is heated from 50° to 500° F. before or during hot stripping.

8. The process of claim 1 wherein catalyst is cooled before or during primary stripping by addition of more than 5 wt % stripping fluid having a temperature below 500° F.

9. The process of claim 1 wherein catalyst is cooled before or during primary stripping by indirect heat exchange.

10. The process of claim 2 wherein catalyst is heated by direct contact heat exchange with added regenerated catalyst.

11. A fluid catalytic cracking process for cracking hydrocarbons comprising:

(a) mixing in a base portion of a riser reactor cracking catalyst containing at least 25 wt % zeolite Y, based on the zeolite Y content of makeup FCC catalyst, and crackable hydrocarbon feed at riser cracking conditions including a catalyst: feed weight ratio of 1:1 to 10:1 and mixture temperature within the range of 975° to 1200° F., and a pressure from about atmospheric to 50 psig;

(b) cracking said feed in said riser reactor to produce cracked hydrocarbon products including C2–C4 olefins and spent catalyst containing coke and adsorbed and entrained hydrocarbon vapor which are discharged from the top of the riser reactor at a temperature of 950° to 1150° F.;

(c) separating said spent catalyst from said cracked hydrocarbon products to produce a cracked product stream which is removed as a product and a spent catalyst stream containing adsorbed and entrained hydrocarbons including C2–C4 olefins at a temperature of 950° to 1150° F. and sufficiently high to cause catalytic condensation reactions of said adsorbed and entrained C2–C4 olefins on said cracking catalyst to form coke;

d) cooling said spent catalyst by at least 10° F. to produce quenched spent catalyst;

(e) stripping said quenched catalyst in a primary catalyst stripping means at catalyst stripping conditions including a catalyst residence time of 10 to 600 seconds by contact with stripping steam in an amount equal to 0.5 to 5.0 wt % of fresh feed to produce stripped quenched catalyst containing a reduced amount of adsorbed and entrained hydrocarbon vapor and a primary stripper vapor product comprising stripping fluid and desorbed and displaced hydrocarbons which is removed as a product from said primary stripping means;

f) heating said stripped quenched catalyst at least 10° F. to produce heated spent catalyst;

(g) stripping said heated spent catalyst in a secondary catalyst stripping means by contact with a stripping fluid at catalyst stripping conditions including a catalyst residence time of 20 to 2000 seconds to produce hot stripped catalyst and a secondary stripper vapor product comprising stripping fluid and desorbed hydrocarbons;

(h) regenerating said hot stripped catalyst in a catalyst regeneration means operating at 1000° to 1500° F., by contact with oxygen or an oxygen containing gas to produce regenerated catalyst; and (i) recycling said regenerated catalyst to said cracking reactor to crack additional amounts of hydrocarbon feed.

12. The process of claim 11 wherein the spent catalyst is cooled at least 20° F. to produce quenched catalyst.

13. The process of claim 11 wherein the spent catalyst is simultaneously cooled and stripped at least 30° F. in said primary stripper by injection of a stream comprising liquid water.

14. The process of claim 11 wherein the quenched catalyst is heated at least 50° F. before or during hot stripping.

15. The process of claim 11 wherein catalyst is cooled before or during primary stripping by indirect heat exchange.

16. The process of claim 11 wherein catalyst is heated by direct contact heat exchange with added regenerated catalyst before or during said secondary stripping.

17. A fluid catalytic cracking process for cracking hydrocarbons comprising:

(a) mixing regenerated cracking catalyst, containing at least 30 wt % Y zeolite, based on the Y zeolite content of fresh catalyst added to the process, and crackable hydrocarbon feed in the base of a riser reactor cracking zone at an average mixture temperature within the range of 975° to 1200° F.;

(b) cracking said feed in said cracking zone to produce cracked hydrocarbon products including C2 to C4 olefins and spent catalyst;

(c) separating said spent catalyst from said cracked hydrocarbon products to produce a spent catalyst stream containing coke and entrained and adsorbed hydrocarbon vapor and having a temperature of 950° to 1150° F. and sufficient to polymerize said olefins to form high molecular weight polymers which condense onto said spent catalyst;

(d) cooling said spent catalyst by at least 20° F. to produce quenched catalyst by injecting a quench stream comprising liquid water;

(e) stripping said quenched catalyst in a primary catalyst stripping means at catalyst stripping conditions including a catalyst residence time of 10 to 600 seconds by contact with a stripping fluid to produce stripped quenched catalyst containing a reduced amount of adsorbed C2–C4 olefins and a primary stripper vapor product comprising stripping fluid and desorbed C2–C4 olefins which are removed as a product from said primary stripping means;

(f) heating said stripped quenched catalyst at least 25° F. by direct contact heat exchange with regenerated cracking catalyst to produce heated spent catalyst;

(g) stripping said heated spent catalyst in a secondary catalyst stripping means by contact with a stripping fluid at catalyst stripping conditions including a catalyst residence time of 20 to 2000 seconds to produce hot stripped catalyst and a secondary stripper vapor product comprising stripping fluid and desorbed hydrocarbons;

(h) regenerating said hot stripped catalyst in a catalyst regeneration means operating at catalyst regeneration conditions to produce regenerated catalyst; and (i) recycling said regenerated catalyst to said cracking reactor to crack additional amounts of hydrocarbon feed.

* * * * *